US005349949A

United States Patent [19]

Schegerin

[11] Patent Number: 5,349,949

[45] Date of Patent: Sep. 27, 1994

[54] FACE MASK WITH LIP, FOLD, AND RESILIENT SPRING MEANS TO IMPROVE SEAL

[75] Inventor: Robert Schegerin, Jouy En Josas, France

[73] Assignee: Intertechnique, Plaisir, France

[21] Appl. No.: 955,157

[22] Filed: Oct. 1, 1992

[30] Foreign Application Priority Data

Oct. 3, 1991 [FR] France ..... 91 12184

[51] Int. Cl.[5] ..... A62B 18/08; A62B 17/04

[52] U.S. Cl. ..... 128/206.24; 128/207.11; 128/201.24

[58] Field of Search ..... 128/203.29, 204.18, 128/205.25, 206.12, 206.16, 206.21, 206.23, 206.24, 207.11, 201.22–201.24

[56] References Cited

U.S. PATENT DOCUMENTS

| | | | |
|---|---|---|---|
| 1,070,986 | 8/1913 | Richter | 128/203.29 |
| 1,193,002 | 8/1916 | Engstad | 128/203.29 |
| 1,281,937 | 10/1918 | Gamble | 128/203.29 |
| 2,641,253 | 6/1953 | Engelder | 128/203.29 |
| 2,706,983 | 4/1955 | Matheson et al. . | |
| 4,069,516 | 1/1978 | Watkins | 2/248 |
| 4,907,584 | 3/1990 | McGinnis | 128/206.24 |

FOREIGN PATENT DOCUMENTS 9200120 1/1992 PCT Int'l Appl. .

*Primary Examiner*—Kimberly L. Asher
*Attorney, Agent, or Firm*—Larson and Taylor

[57] ABSTRACT

The equipment, for use by a pilot, is intended to provide the wearer with breathing gas under a pressure greater than ambient pressure. It comprises a mask having a rigid shell provided with fastening straps for holding the mask on the head, with a coupling for feeding breathing gas under pressure, and with a face cover of elastomer material terminated by an internal sealing lip for pressing against the face. The lip is connected to a front portion of the face cover that is secured to the shell by at least one thin deformable fold. Resilient elements are provided along the fold to exert a force that varies little with the amount of deformation and press the lip against the face.

12 Claims, 2 Drawing Sheets

FACE MASK WITH LIP, FOLD, AND RESILIENT SPRING MEANS TO IMPROVE SEAL

BACKGROUND OF THE INVENTION

The present invention relates to breathing equipment designed to supply the wearer with breathing gas under a pressure greater than ambient pressure, the equipment being of the type comprising a face mask having a rigid shell provided with means for fastening to head straps, a coupling for feeding breathing gas under pressure, and a face-cover of elastomer material terminated by at least one lip for bearing against the face.

Very often, particularly during military missions, a mask must be worn permanently even though it is used only exceptionally or only during a short fraction of a mission. This gives rise to requirements that, until now, have been to a large extent contradictory. The mask must be continuously in place in such a manner that immediately on it being fed with breathing gas under pressure, leaks are avoided along the zone of contact between the mask and the skin. Attempts have been made to achieve this result by providing the face-cover with an internal lip that tends to be pressed against the face by pressure inside the mask. However, for that to work, it is necessary for there to be no initial leakage preventing the pressure from building up significantly. To limit this risk, the straps must be tight enough to press the mask against the face. However, under such circumstances, the zone where the lip presses against the face quickly becomes painful. In addition, the difference in hardness between the various zones of the face, the lack of an accurate fit between the mask and various different possible wearers, and the risk of the mask being put into place inaccurately, all combine to ensure that the danger of leaks is not eliminated completely.

To reduce discomfort, proposals have already been made to interpose flexible folds between the front portion of the mask which is fitted with the strap and a rear portion that bears against the face, and in particular against the bridge of the nose, which folds make it possible to improve contact for a given application force due to the strap (U.S. Pat. No. 2,706,983). However, although that solution is acceptable when feeding air through a filter which does not give rise to an increase in pressure, it cannot guarantee initial airtight application of a mask that is intended, under some circumstances, to receive a breathing gas under pressure. Proposals have also been made (U.S. Pat. No. 4,069,516) for a breathing mask designed to be connected to a demand regulator and including a coupling front portion and a rear portion constituting a sealing lip, which portions are connected to each other by a flexible fold constituting a hinge. Like the preceding solution, that solution is not entirely satisfactory. If the mask is not accurately fitted to the face, then the lip can lift off locally, thus giving rise to leaks when gas is fed to the mask.

SUMMARY OF THE INVENTION

The present invention seeks to provide breathing equipment including a mask of the above-defined type in which the face-cover has an internal sealing lip separated from a front portion secured to the shell by at least one deformable thin fold, characterized by resilient means exerting a force along the fold that varies little with the amount of deformation of the means and that tends to urge the lip against the face.

It is important for the resilient means to exert forces that are sufficiently spread out for there to be no risk of a gap existing in a place where the face has a hollow between two adjacent support points. For this purpose, the resilient means advantageously comprise relatively independent elements disposed at short intervals, e.g. at intervals of about 1 cm. It is sufficient for the resilient means and the fold to make displacement towards and away from the face possible through an amplitude that is less than 1 cm. This result can be achieved, in particular, by providing a single deformable thin fold having a depth lying in the range 5 mm to 15 mm. This depth may be smaller when several folds are located in series relationship. One solution that can give good results consists in providing two, or even more folds in zones where a maximum amount of adaptability is required (e.g. close to the bridge of the nose) and only one fold elsewhere.

The resilient means may be constituted, in particular, by Ω-shaped springs molded in the fold and projecting to either side, or covering said fold on the inside and/or on the outside. These springs may be completely independent from one another or they may be interconnected by a strip that connects together the bottoms of the loops, thereby facilitating manufacture. It suffices for the springs to provide an application force lying in the range 0.2 grams per millimeter (g/mm) to 5 g/mm to guarantee sufficient sealing to allow pressure to be established inside the mask.

At present, a mask for an aircraft pilot is generally connected to a helmet, which means that the mask could be dislodged and sealing could be broken if the helmet slips, e.g. during high-g maneuvering or because a bladder at the back of the head has been put under pressure. In an advantageous, but by no means exclusive embodiment of the invention, the shell of the mask is connected by the straps to a hairnet or to a head clamp placed directly against the scalp, beneath the helmet.

The invention will be better understood on reading the following description of particular embodiments, given as non-limiting examples.

DETAILED DESCRIPTION OF PREFERRED EMBODIMENTS

Figure 1:
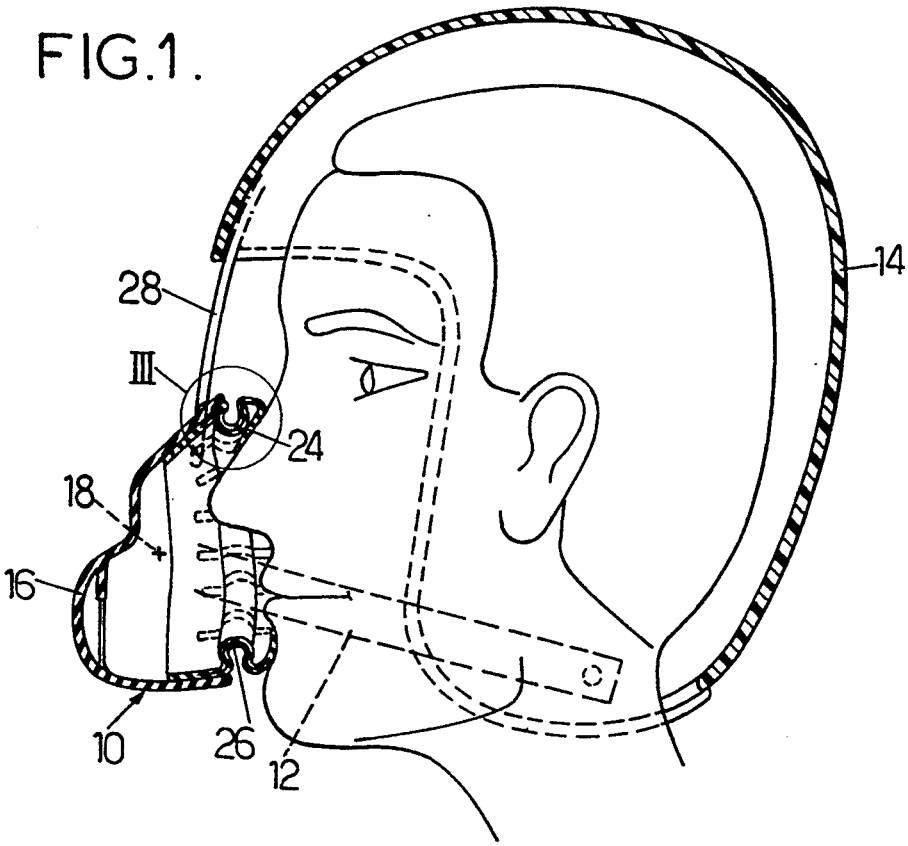
FIG. 1 is a diagram showing a mask according to a particular embodiment of the invention in cross section on a vertical plane, with the mask in place on a user.

The breathing equipment shown by-way of example in FIG. 1 comprises a breathing mask 10 for attachment by means of straps 12 to a helmet 14 shown in outline only. The mask comprises a conventional shell 16 provided with strap fastening means 12 which may be of the kind described in U.S. Pat. No. 5,003,632, for example. Said rigid shell may be made of hard plastic and is provided with a coupling 20' for coupling to a breathing gas feed duct, e.g. via a demand regulator. The shell may also include breathe-out and/or anti-suffocation valves.

A face-cover 20 is disposed at the rear of the shell 16 and is constituted by a single piece of flexible elastomer. The face-cover is generally flared in shape from front to back. It may be considered as comprising a front portion which is sealingly secured to the rear of the shell 16, a rear portion terminated by an internal lip 24, and an intermediate portion including at least one fold 26.

In particular, the front portion may be bonded to the inside of the shell. The edge of the shell may terminate before the beginning of the fold, as shown in solid lines in FIG. 3. Alternatively, it may extend over the fold, as shown in dot-dashed lines. The second option has the advantage of protecting the fold against external attack. The extension may also be necessary so that the visor 28 of the helmet bears against the shell and not against the face-cover. It may be preferable to bond the rear portion of the face-cover 20 to the shell 7 starting only at a distance a from the rear edge of the face-cover, so as to increase the flexibility of the intermediate portion.

Figure 2:
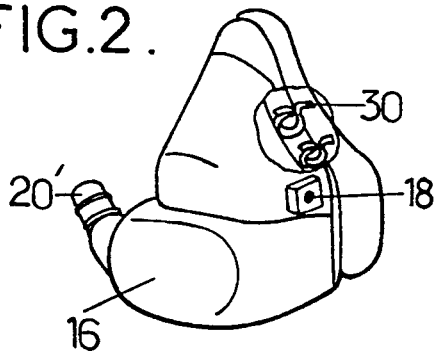
FIG. 2 is a perspective view of the mask.
Figure 4:
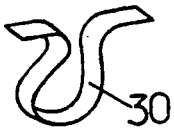
FIG. 4 is a perspective view of a spring usable in a mask of the kind shown in FIG. 1.

Seen from behind, the rear portion for engaging the face is generally triangular in shape with an internal lip that bends forwardly considerably more in its zone that overlies the bridge of the nose. Even if a plurality of mask sizes are provided, the fact that the mask is not custom made means that while it is in the un-compressed state, it is not an accurate fit to the face of any wearer. In order to enable the lip to fit the face with only small pressure being exerted by the straps 12, the intermediate portion 26 is constituted by a flexible fold, whose flexibility may be obtained by a reduction in thickness relative to the front portion of the face-cover. The fold extends generally towards the inside of the mask, even though that disposition is not absolutely essential. In the example shown in FIGS. 1 to 3, the fold is rounded in shape having an Ω-section that is wide open at rest. When the mask is put into place and the straps are tensioned, the fold closes up over points where the face-cover presses against the face, e.g. taking up the shape shown in dashed lines in FIG. 3. Providing the depth l of the fold is sufficient, the deformation can take up any appropriate value to enable the mask to be fitted to any shape of face.

On its own, the presence of the fold merely makes it possible for deformation to be sufficient to enable the entire periphery of the lip to bear against the face. But because of its flexibility, the fold does not press the lip against the face. Consequently, unless the tension exerted by the straps is so high as to compress the fold all the way around, thereby exerting pressure against the face that becomes painful locally, gaps in sealing can remain over recessed portions of the face.

This risk is avoided by providing the intermediate portion with resilient means that exert a force all along the fold that varies little with the degree to which the fold is deformed, and that tends to press the lip uniformly against the face. The resilient means are such that initial contact between portions of the lip and projecting portions of the face does not give rise to a reduction in the effect of the resilient means between said portions, i.e. does not prevent them from pressing the lip against recessed portions of the face.

In the embodiment shown in FIGS. 1 to 4, the resilient means are constituted by thin flat springs made of steel, for example, that are Ω-shaped, and that are embedded in the thickness of the fold and also in regions of the front and rear parts which are adjacent to the fold. The width of individual springs is a few millimeters, for example, and the springs are distributed with inter-spring gaps that are greater than said width. Satisfactory results can often be obtained with springs having a width of about 5 mm and with gaps that are about double that size. It may be advantageous to locate the springs closer together where the face-cover bears against a portion of the face that projects markedly.

Figure 8:
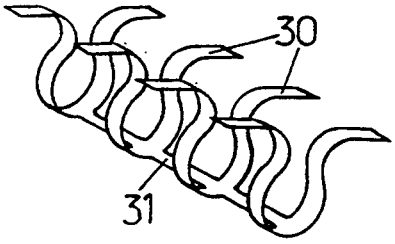
FIG. 8 is similar to FIG. 3 and shows yet another modification.

To facilitate installing the springs 30, they may be mutually connected by means that leave them free to deform independently from one another. For example, the loops of the springs may be interconnected by a strip 31, as shown in FIG. 8. It is thus possible, by stamping and rolling to make up a module that can be handled as a single piece, and that is easy to install in a die of a mold.

Figure 6:
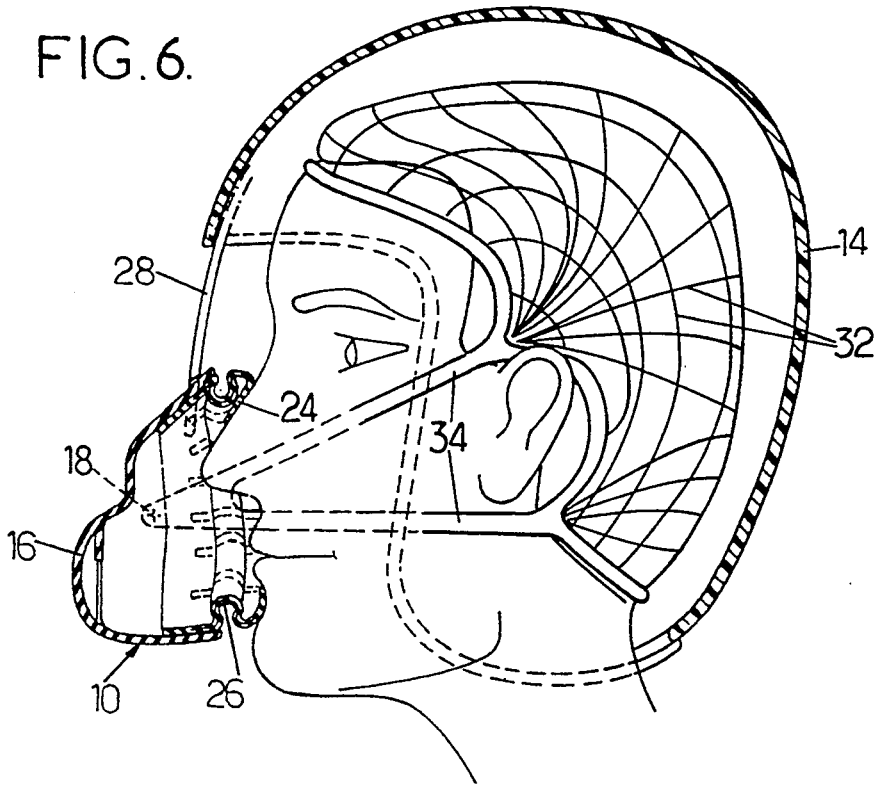
FIGS. 6 and 7 are similar to FIGS. 1 and 3 and show a possible way of mounting the resilient means outside the mask, inside the fold.
Figure 7:
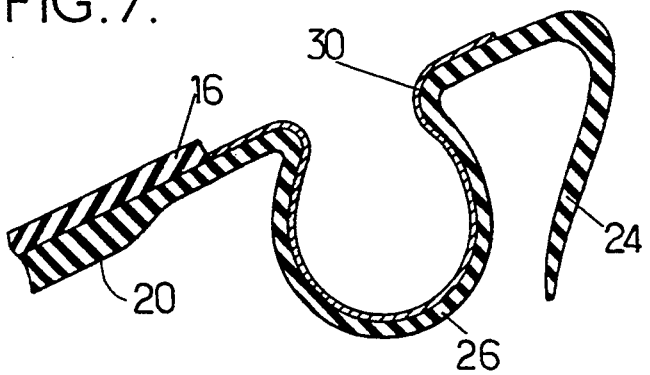

In the modified embodiment shown in FIGS. 6 and 7, the springs constituting the resilient means are placed on the outside of the face-cover and they are secured thereto by bending.

As shown in FIG. 6, the mask may be secured to the head independently of any possible helmet, thereby avoiding the risk of the mask being moved by displacements of the helmet. The mask-securing means of FIG. 6 comprise a hairnet 32 fitted over the head and leaving the ears free, with the hairnet being connected to the shell by straps 34 that are adjustable in length. The hairnet may be replaced by fittings enabling the straps to bear against the back of the head.

Figure 3:
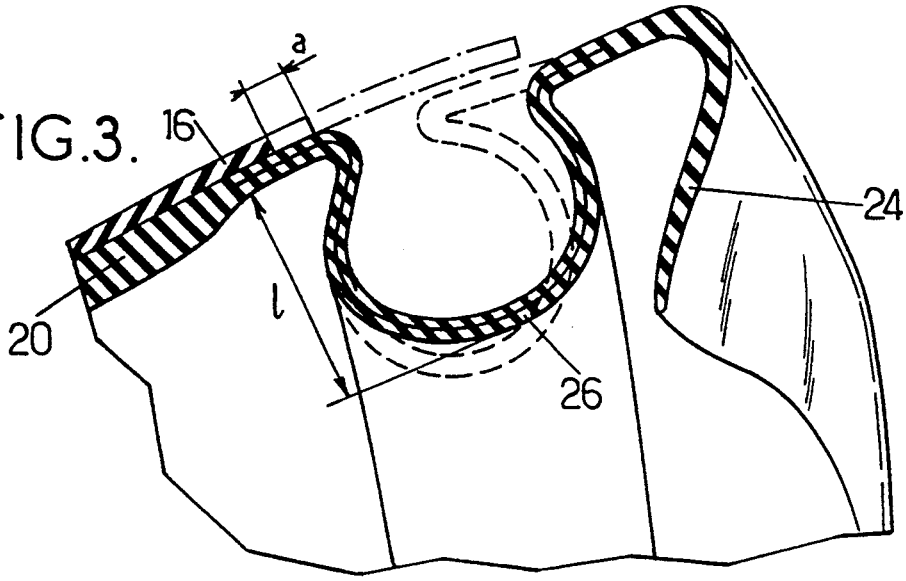
FIG. 3 is an enlargement of portion III in FIG. 1, the fold being shown in solid lines in its relaxed state, as occurs before the mask is put into place on the face.
Figure 5:
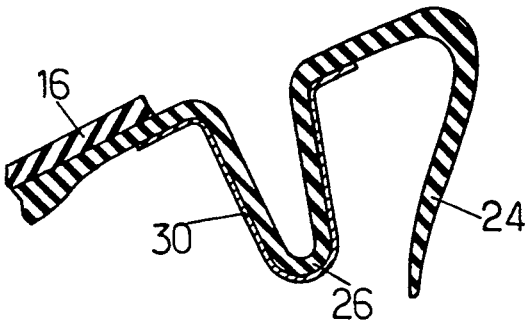
FIG. 5 shows a modification of FIG. 4.

The fold (or folds) and the resilient means may have a wide variety of shapes. In the example shown in FIG. 5, the resilient means are constituted by V-shaped springs 30*a* that are independent or that have their tips interconnected by a strip. The following other possible shapes may be mentioned by way of non-limiting example:

V-shaped springs whose tips are replaced by respective small-diameter loops so as to avoid stress concentrations;

resilient means constituted by a wire, e.g. made of spring steel, constituting a frieze having successive adjacent Ω-shaped portions connected together;

spaced-apart individual helical springs each tending to open up the fold (i.e. urging the fold from the position shown in dashed lines in FIG. 3 towards the position shown in solid lines); and individual rings distributed along the inside of a lined fold to constitute a circumferential channel that projects both towards the inside of the mask and towards the outside thereof.

Numerous modified embodiments of the invention are possible, enabling a mask to be adapted to any particular utilization. Specifically, when the mask is intended for use by an aircraft pilot who may be subjected to high-g forces (tending to drag the mask downwards) and to high internal pressure increases for the purpose of increasing the pilot's ability to withstand acceleration, it is advantageous to place the strap fastening means 18 above the resultant of the pressure forces acting on the mask so as to balance them and maintain sealed application against the face.

The various components may be made using techniques and materials that are conventional in mask manufacture, and that are selected depending on the intended purpose of the mask.

I claim:

1. Breathing equipment for delivering breathing gas under a pressure greater than ambient pressure to a wearer, said equipment comprising a face mask having a face cover of elastomer material, a rigid shell carrying said face cover and provided with fastening means for connection with straps for holding said face cover on a wearer's face, and a coupling for feeding breathing gas under pressure into the mask, wherein said face cover has a lateral wall section and a lip section for bearing against a wearer's face, said lip section being bent inwardly with respect to said lateral wall section, said lateral wall section comprising a front portion sealingly secured to said shell, a rear portion terminated by said lip section, and an intermediate portion comprising at least one deformable circumferential fold connecting said front and rear portions and allowing displacement of said rear portion and said lip section relative to said front portion, and wherein resilient spring means for urging said lip into sealing engagement with a wearer's face are carried by the face cover within said fold, said resilient spring means exerting forces distributed along the fold responsive to the amount of deformation of said resilient spring means and resistance of said fold said resilient spring means opening said fold and urging said lip section against a wearer's face.

2. Equipment according to claim 1, wherein said resilient spring means comprise a plurality of relatively independent spring elements disposed at close intervals.

3. Equipment according to claim 1, wherein said resilient spring means and said fold are proportioned and dimensioned to allow amounts of displacements towards and away from the face not in excess of 1 cm.

4. Equipment according to claim 3, wherein there is only one said fold having a depth lying in the range 5 mm to 15 mm.

5. Equipment according to claim 1, wherein said resilient spring means are constituted by a plurality of Ω-shaped springs molded in said fold and projecting from either side thereof.

6. Equipment according to claim 5, wherein said springs are interconnected by a strip (31) joining bottoms thereof.

7. Equipment according to claim 5, wherein said springs are flat with a width smaller than their mutual spacing.

8. Equipment according to claim 1, wherein said resilient spring means are constituted by a plurality of Ω-shaped springs overlying at least one of the inside and the outside of said fold.

9. Breathing equipment for delivering breathing gas under a pressure greater than ambient pressure to a wearer, said equipment comprising a face mask having a face cover of elastomer material terminated by at least one inturned lip for bearing against a wearer's face, a rigid shell carrying said face cover and provided with fastening means for connection with straps for holding said face cover on a wearer's face, and a coupling for feeding breathing gas under pressure into the mask, wherein said lip is separated from a front portion of the face cover that is secured to the shell by at least one thin deformable circumferential fold of said face cover and wherein resilient means for urging said lip into sealing engagement with a wearer's face, constituted by a plurality of Ω-shaped springs molded in said fold and projecting from either side thereof, carried by the face cover exert forces distributed along the fold whose variation responsive to the amount of deformation of said resilient means and fold are small and which are directed to urge said lip against a wearer's face.

10. Equipment according to claim 9, wherein said springs are interconnected by a strip joining bottoms thereof.

11. Equipment according to claim 9, wherein said springs are flat with a width smaller than their mutual spacing.

12. Breathing equipment for delivering breathing gas under a pressure greater than ambient pressure to a wearer, said equipment comprising a face mask having a face cover of elastomer material terminated by at least one inturned lip for bearing against a wearer's face, a rigid shell carrying said face cover and provided with fastening means for connection with straps for holding said face cover on a wearer's face, and a coupling for feeding breathing gas under pressure into the mask, wherein said lip is separated from a front portion of the face cover that is secured to the shell by at least one thin, deformable circumferential fold of said face cover and wherein resilient means for urging said lip into sealing engagement with a wearer's face, constituted by a plurality of Ω-shaped springs overlying at least one of the inside and the outside of said fold and carried by the face cover, exert forces distributed along the fold whose variation responsive to the amount of deformation of said resilient means and fold are small and which are directed to urge said lip against a wearer's face.

* * * * *